United States Patent [19]

Lee

[11] Patent Number: 4,936,413

[45] Date of Patent: Jun. 26, 1990

[54] IN-LINE NOISE ATTENUATION DEVICE FOR A GAS CONDUIT

[75] Inventor: Carlos Lee, Chatham, Canada

[73] Assignee: Siemens-Bendix Automotive Electronics Limited, Chatham, Canada

[21] Appl. No.: 377,672

[22] Filed: Jul. 10, 1989

[51] Int. Cl.[5] ..... F01N 1/08

[52] U.S. Cl. ..... 181/264; 181/229; 181/265

[58] Field of Search ..... 181/227–229, 181/247–250, 264, 265, 269

[56] References Cited

U.S. PATENT DOCUMENTS

| | | | |
|---|---|---|---|
| 2,671,523 | 3/1954 | Walker | 181/264 |
| 3,888,332 | 6/1975 | Roe et al. | 181/264 |
| 4,172,508 | 10/1979 | Moss et al. | 181/265 |
| 4,550,799 | 11/1985 | Flugger | 181/265 X |
| 4,782,912 | 11/1988 | Wandless | 181/229 |

*Primary Examiner*—Benjamin R. Fuller

*Attorney, Agent, or Firm*—George L. Boller; Russel C. Wells

[57] ABSTRACT

An in-line noise attenuation device for insertion into a gas induction system, such as the air induction system of an automotive vehicle internal combustion engine. The device comprises two plastic parts snap-fitted together. One part is an outer tube, and the other part, an insert disposed within the first part. The insert comprises a hollow ogival-shaped section that is axially coextensive with a frusto-conically shaped section of the outer tube to form an annular flow path of substantially constant cross section for the inducted air. The flow then passes through apertures in the insert to enter a venturi section. The flow continues through the venturi section and then exits the device. The venturi section serves to choke noise that propagates from the engine in the direction opposite the direction of airflow. The noise is reflected back to the engine by the hollow interior of the ogival-shaped section which is open toward the venturi section.

15 Claims, 2 Drawing Sheets

FIG. 1
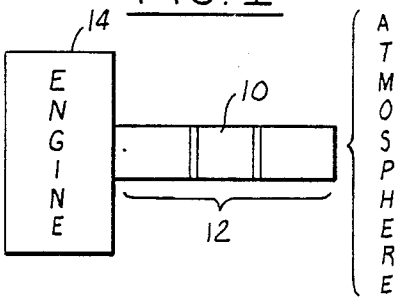
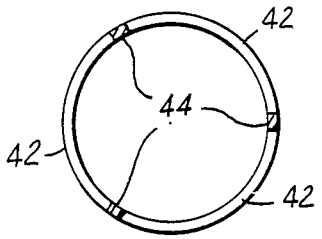
FIG. 4
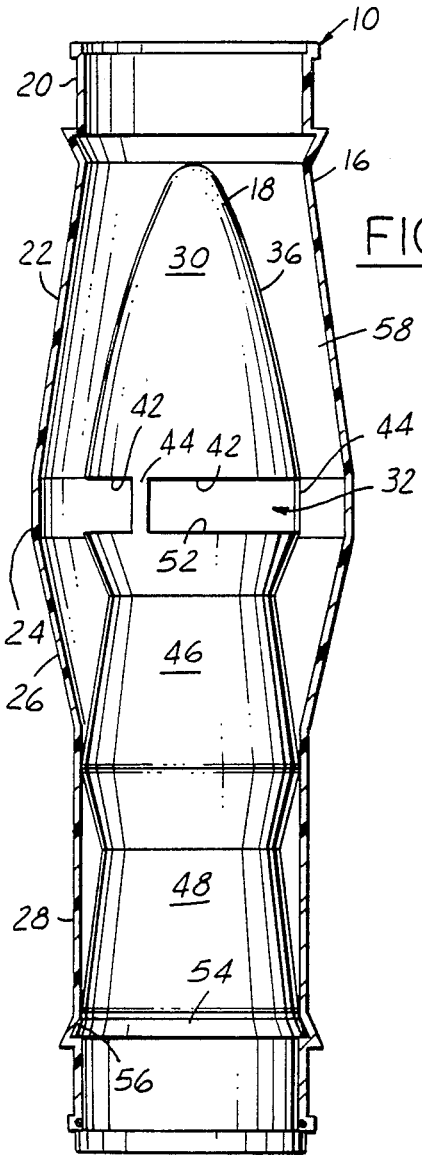
FIG. 2
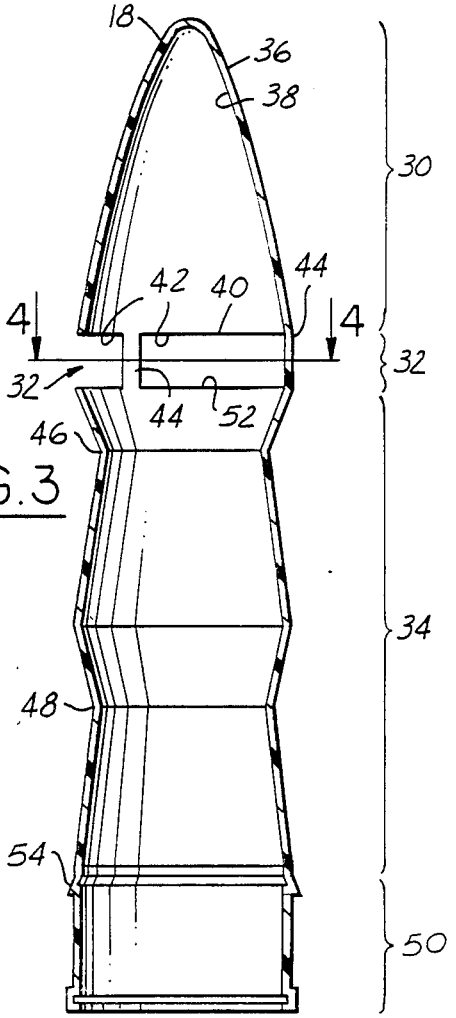
FIG. 3

IN-LINE NOISE ATTENUATION DEVICE FOR A GAS CONDUIT

BACKGROUND AND SUMMARY OF THE INVENTION

This invention relates to an in-line noise attenuation device for a gas conduit where the gas conduit conveys gas toward a noise source. The device functions to attenuate noise that propagates from the noise source through the conduit in the direction opposite the direction of gas flow without causing serious restriction of the gas flow.

In the air induction system of a naturally aspirated internal combustion engine, air is drawn into the engine by virtue of the manifold vacuum that is created in the intake manifold as the pistons reciprocate within the cylinders. In automotive vehicles powered by such engines, it is typical practice to draw fresh intake air from the atmosphere through a flow path leading from the engine to an intake that is located away from the engine. The action of the engine creates noise that can readily propagate back through the air induction system and escape. Too high a level of such noise can be deemed objectionable.

The present invention is directed to a device that can attenuate this noise without introducing serious restriction to the flow of air into the engine. In particular the device of the invention is adapted for in-line insertion into the air induction system. Moreover, the device of the invention can be fabricated in a very convenient manner from only two plastic parts.

The foregoing features, advantages, and benefits of the invention, along with additional ones, will be seen in the ensuing description and claims that are accompanied by the drawings. The drawings disclose a presently preferred embodiment of the invention in accordance with the best mode contemplated at the present time in carrying out the invention.

BRIEF DESCRIPTION OF THE DRAWINGS

FIG. 1 illustrates schematically one manner of using the device of the invention.

FIG. 2 is an elevational view, partly in cross section, through a first embodiment of the device.

FIG. 3 is a cross sectional view through one of the parts of the device of FIG. 2 shown by itself.

FIG. 4 is a transverse cross sectional view taken in the direction of arrows 4—4 in FIG. 3.

DESCRIPTION OF THE PREFERRED EMBODIMENT

Figure 7:
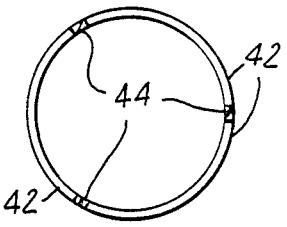
FIG. 7 is a transverse cross sectional view taken in the direction of arrows 7—7 in FIG. 6.

FIG. 1 illustrates usage of an in-line noise attenuation device 10 in the air intake system 12 of an automotive internal combustion engine 14. Device 10 is inserted in-line in intake system 12 so that air from the atmosphere that is drawn into engine 14 passes through the device without significant restriction of the airflow while the device attenuates noise that propagates back through the air intake system toward atmosphere. Details of device 10 are presented in FIGS. 2-4.

The device comprises a two part assembly consisting of an outer tubular part 16 and an insert 18 that is coaxially disposed within part 16. Both parts can be advantageously fabricated from suitable plastic by conventional plastic fabrication procedures. Nylon is a good material for high temperature usage, while polypropylene is a more economical material where high temperatures are not encountered.

Part 16 comprises a straight circular inlet section 20 leading to a frusto-conically shaped section 22 of increasing taper. Section 22 in turn leads to a short straight section 24. A frusto-conically shaped section 26 of decreasing taper extends from section 24 to a straight circular section 28 that forms the end of part 16 opposite inlet section 20. These sections 20, 22, 24, 26, and 28 are coaxial. The end sections of part 16 are shaped to provide for the connection of hoses (not shown) when the device is installed in the intake system.

Part 18 comprises an ogival-shaped section 30, an aperture section 32, and a venturi section 34. These sections are coaxial. Ogival-shaped section 30 is axially co-extensive with frusto-conically shaped section 22; aperture section 32, with straight section 24; and venturi section 34, with sections 26 and 28.

Ogival-shaped section 30 points toward, and is coaxial with, inlet section 20. It is also hollow, comprising an exterior wall surface 36, an interior wall surface 38, and a circular opening 40 at the end that is toward venturi section 34.

Aperture section 32 comprises three identical, spaced apart circumferentially extending openings 42 that are of uniform axial dimension. Openings 42 are separated from each other by bars 44 that serve to join section 30 with section 34.

Venturi section 34 comprises two in-line venturis 46, 48. There is a short straight section 50 at the end of part 18. Venturi 46 comprises a circular ideal entrance 52, and this ideal entrance, as well as the two venturis 46, 48, are coaxial with section 30. Entrance 52, opening 40, and the area of outlet section 50 are substantially identical. For best noise attenuation, the area of opening 40 should be at least as large as the area of entrance 52. At the junction of venturi 48 and section 50, the outside of part 18 is provided with a circumferentially continuous ridge 54, of triangular cross section, and ridge 54 fits into a complementary shaped groove 56 within part 16. This provides a snap-fit attachment of the two parts 16, 18.

Airflow enters device 10 as a column at inlet section 20. It then passes through the annular space 58 that is defined between the exterior surface 36 of ogival-shaped section 30 and the interior surface of frusto-conically shaped section 22. Sections 30 and 22 are designed such that the transverse cross sectional area of space 58 is substantially constant throughout its length and substantially the same as the transverse cross sectional area of inlet section 20. This design provides minimum disruption and restriction of the airflow in this region.

Venturi section 34 has a very close fit within section 28 of part 16 so that flow between the two parts 16, 18 is not possible beyond aperture section 32. Accordingly, the flow from space 58 passes through apertures 42 and into entrance 52. The flow continues through the two venturis 46, 48 to exit the device through the circular open end of section 50.

Aperture section 32 is designed such that for the particular type of gas flowing through the device, formation of the vena contracta caused by the flow separation takes place in a smooth fashion so as to maintain very low flow restriction. The ideal entrance is designed to also keep the flow restriction to a minimum.

The venturi section 34 is designed around the vena contracta, i.e. the natural minimum diameter, such that it is "invisible" to flow, but effective for noise attenuation. Noise that enters section 50 passes through the venturi section and is "choked" in the process. The noise is first choked by venturi 48. The choking has two purposes: first, to reduce the noise by reducing the cross sectional area through which the sound is travelling; and second, to "concentrate" the noise to the center. These effects are repeated as the noise passes through venturi 46.

As the noise leaves venturi 46 through airflow entrance 52, it propagates toward the interior of the hollow ogival-shaped section 30 where it is reflected back through the venturi section 34 to the engine and/or creates a standing wave. In this way, the noise that exits the device through the airflow inlet section 20 is significantly attenuated from the level at which it emanates from the engine.

Although the illustrated device comprises two venturis in the venturi section, it is contemplated that the number may be other than two in certain designs. The size of the aperture section may vary from design to design, but in any event it will generally be a compromise between flow restriction and noise escape. Increasing the aperture size tends to reduce the airflow restriction, but at the expense of allowing more noise to escape, and vice versa. For usage in the air induction system of one engine, the device has been found effective in attenuating noise in the range of 0–500 hertz by 3–4 db. The device is also effective in attenuating noise peaks, and this is believed due to the effectiveness of the hollow interior of the ogival-shaped section.

Figure 5:
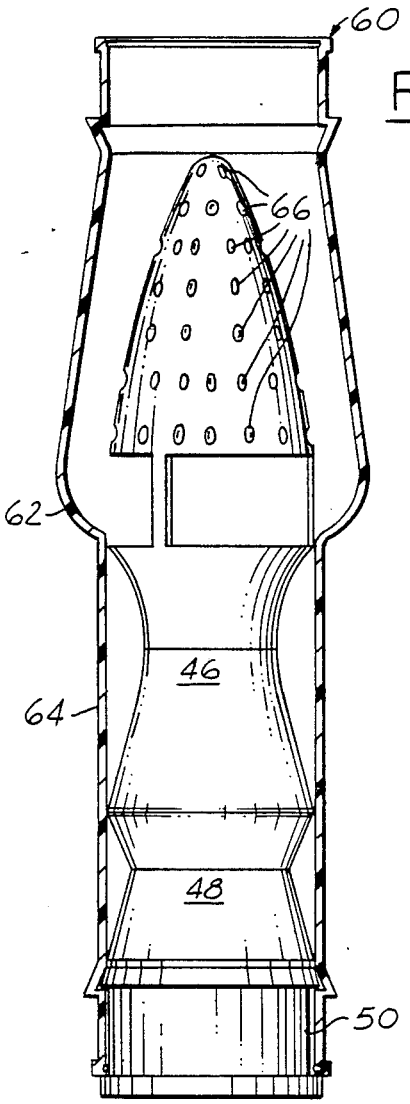
FIG. 5 is a view similar to FIG. 2, but of a second embodiment.
Figure 6:
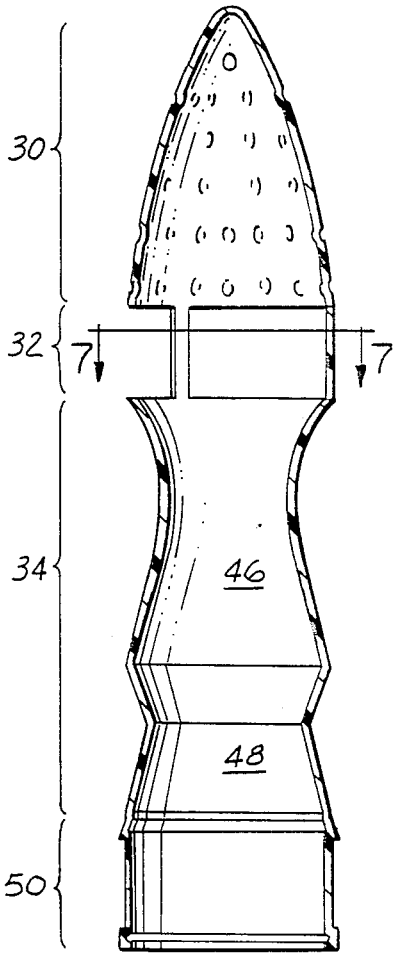
FIG. 6 is a cross sectional view through one of the parts of the device of FIG. 5 shown by itself.

FIGS. 5–7 portray a second embodiment 60 of device in which corresponding parts of device 10 are identified by like reference numerals. Tube 16 of device 60 has a slightly different shape wherein a curved section 62 that is axially coextensive with aperture section 32 leads to a straight section 64 that is axially coextensive with the venturi section 34 and the section 50. The venturi sections are also differently shaped from the shapes of device 10. A final difference is that &:he ogival-shaped section 30 contains a pattern of dimples 66 that promotes smoother flow over this section.

While a preferred embodiment of the invention has been disclosed, it will be appreciated that principles are applicable to other embodiments. The invention can also be used in other applications, such as the intake systems of turbines and ventilation systems.

What is claimed is:

1. A low restriction in-line noise attenuation device for insertion into a conduit that conveys gas toward a noise source so that noise that propagates back from the noise source through the conduit is attenuated by the device without the device imposing serious restriction on the gas flow, said device comprising an inlet of given transverse cross sectional area at which gas flow enters the device in a column, said inlet merging into a means defining a zone of annular transverse cross section that circumferentially expands in a direction of gas flow while maintaining a substantially constant transverse cross sectional area that is substantially equal to said given transverse cross sectional area, said means defining a zone of annular transverse cross section merging into a means to circumferentially contract the gas flow back into a column, said means to circumferentially contract the gas flow back into a column merging into a venturi section having an entrance at which the circumferentially contracted column of gas flow enters the venturi section, the gas flow passing through the venturi section to an outlet, and wall means confronting said entrance of said venturi section in spaced relation thereto for reflecting noise that enters said outlet and passes through said venturi section back through said venturi section and said outlet.

2. A device as set forth in claim 1 in which said means defining a zone of annular transverse cross section is defined by a radially outer wall of frusto-conical shape and a radially inner wall of ogival shape.

3. A device as set forth in claim 2 in which said radially inner wall of ogival shape and said wall means are exterior and interior surfaces respectively of a hollow ogival-shaped member whose interior is open toward said entrance.

4. A device as set forth in claim 3 in which said ogival-shaped member has a circular opening facing said entrance, said entrance also being a circular opening, said circular openings being coaxial, and the cross sectional areas of said circular openings being substantially equal.

5. A device as set forth in claim 3 including a pattern of dimples formed in said hollow ogival-shaped member.

6. A device as set forth in claim 3 in which said ogival-shaped member is joined to said venturi section by a number of circumferentially spaced apart bars that define apertures through which the gas flow passes before entering said entrance.

7. A device as set forth in claim 6 in which said ogival-shaped member, said bars, and said venturi section are formed as a single part.

8. A device as set forth in claim 7 in which said radially outer wall is a portion of a tubular part and said single part is disposed within said tubular part.

9. A device as set forth in claim 1 in which said venturi section comprises a succession of venturis.

10. A device as set forth in claim 1 disposed in-line in an air induction system of an internal combustion engine.

11. A low restriction in-line noise attenuation device for insertion into a conduit that conveys gas toward a noise source so that noise that propagates back from the noise source through the conduit is attenuated by the device without the device imposing serious restriction on the gas flow, said device comprising a tube that is open at both ends, one of said ends being a gas inlet to the device, said tube having a section of increasing diameter extending away from said one end followed by a section of decreasing diameter that is in turn followed by a further section leading to the other end of said tube, an insert disposed within said tube, said insert comprising a venturi section disposed within said further section of said tube, said venturi section having an entrance and an outlet for gas flow, an ogival section disposed within and in inwardly spaced relation to said increasing diameter section of said tube, circumferentially spaced bars joining said ogival section to said venturi section so that apertures are provided in said insert between said venturi section and said ogival section, said device forming a gas flow path that comprises, in a direction of flow, the space between said increasing diameter section of said tube and said ogival section, said apertures, and said venturi section, said ogival section being hollow and open toward said venturi section so that noise that enters said outlet and passes through said venturi section is reflected by the hollow interior of said ogival section back through said venturi section and said outlet.

12. A device as set forth in claim 11 in which said inlet, said space between said increasing diameter section of said tube and said ogival section, the entrance to said venturi section, and said outlet have substantially equal transverse cross sectional areas.

13. A device as set forth in claim 11 in which said venturi section comprises a succession of venturis.

14. A device as set forth in claim 11 in which said insert has a snap-fit attachment to said tube.

15. A device as set forth in claim 11 disposed in-line in an air induction system of an internal combustion engine.

* * * * *